US010384814B2

(12) United States Patent
Scrivani

(10) Patent No.: US 10,384,814 B2
(45) Date of Patent: Aug. 20, 2019

(54) MACHINE FOR ASSEMBLING, FILLING AND SEALING PORTIONED BEVERAGE CAPSULES

(75) Inventor: Massimo Scrivani, Casteggio (IT)

(73) Assignee: Azionaria Costruzioni Macchine Automatiche A.C.M.A S.p.A, Bologna (IT)

( * ) Notice: Subject to any disclaimer, the term of this patent is extended or adjusted under 35 U.S.C. 154(b) by 483 days.

(21) Appl. No.: 14/240,648

(22) PCT Filed: Sep. 6, 2012

(86) PCT No.: PCT/IB2012/054607
§ 371 (c)(1),
(2), (4) Date: Feb. 24, 2014

(87) PCT Pub. No.: WO2013/035061
PCT Pub. Date: Mar. 14, 2013

(65) Prior Publication Data

US 2014/0202120 A1 Jul. 24, 2014

(30) Foreign Application Priority Data

Sep. 8, 2011 (IT) ..... MI2011A1619

(51) Int. Cl.
*B65B 1/02* (2006.01)
*B65B 43/52* (2006.01)
(Continued)

(52) U.S. Cl.
CPC ..... *B65B 1/02* (2013.01); *B65B 1/12* (2013.01); *B65B 1/24* (2013.01); *B65B 29/025* (2017.08);
(Continued)

(58) Field of Classification Search
CPC ..... B65D 75/46; B65B 7/28; B65B 7/2821; B65B 7/2807; B65B 7/2842
(Continued)

(56) References Cited

U.S. PATENT DOCUMENTS 3,340,668 A 9/1967 Bofinger
3,750,362 A * 8/1973 Kishpaugh ..... B65D 77/2024 206/525
(Continued)

FOREIGN PATENT DOCUMENTS

CH 558739 A * 2/1975 ..... B65B 1/12
CN 87104442 A 1/1988
(Continued)

OTHER PUBLICATIONS

International Search Report and Written Opinion dated Aug. 19, 2013 for Application No. PCT/IB2012/054607.
(Continued)

*Primary Examiner* — Chelsea E Stinson
(74) *Attorney, Agent, or Firm* — Shuttleworth & Ingersoll, PLC; Timothy J. Klima

(57) ABSTRACT

The machine for assembling, filling and sealing capsules for portioned beverages comprises a station for loading the capsules to be assembled, a station for unloading the assembled, filled and sealed capsules, a plurality of processing stations comprising at least one station for metering a product into the capsules and at least one station for sealing the capsules filled with the product, and an intermittent conveyor for conveying the capsules sequentially along a feed path to the unloading station to the unloading station through the processing stations, the feed path having at least a first stretch which extends along a first lateral longitudinal side of the machine and at least a second stretch which
(Continued)

extends along a second lateral longitudinal side of the machine opposite the first lateral side.

25 Claims, 12 Drawing Sheets

(51) Int. Cl.

| | |
|---|---|
| ***B65B 65/00*** | (2006.01) |
| ***B65B 31/02*** | (2006.01) |
| ***B65B 57/14*** | (2006.01) |
| ***B65B 59/04*** | (2006.01) |
| ***B65B 1/12*** | (2006.01) |
| ***B65B 1/24*** | (2006.01) |
| ***B65B 29/02*** | (2006.01) |

(52) U.S. Cl.
CPC ..... *B65B 31/022* (2013.01); *B65B 43/52* (2013.01); *B65B 57/145* (2013.01); *B65B 59/04* (2013.01); *B65B 65/003* (2013.01)

(58) Field of Classification Search
USPC ..... 53/329.4, 282, 266.1, 272, 283, 285, 30
See application file for complete search history.

(56) References Cited

U.S. PATENT DOCUMENTS 3,965,656 A * 6/1976 Gerben ..... B65B 3/32 53/282
4,073,372 A * 2/1978 List ..... B65B 43/50 141/169
4,109,446 A * 8/1978 Krohn ..... B67C 7/002 53/282
4,774,797 A * 10/1988 Colamussi ..... B65B 9/087 53/459
5,269,123 A * 12/1993 Marchesini ..... B29C 65/18 53/329.4
5,477,959 A * 12/1995 Tisma ..... B65G 17/42 198/793
6,418,701 B1 * 7/2002 Navarro ..... B65B 7/2807 221/223
7,392,898 B2 * 7/2008 Bullock ..... B65B 1/32 206/221
7,448,183 B2 * 11/2008 Gertitschke ..... B29C 65/18 53/329.4
2005/0247020 A1 11/2005 Niesar et al.

FOREIGN PATENT DOCUMENTS

| | | | | |
|---|---|---|---|---|
| CN | 1655990 A | 8/2005 | | |
| EP | 0093409 | 11/1983 | | |
| EP | 0566173 | 10/1993 | | |
| WO | 03082679 | 10/2003 | | |
| WO | 2004069658 | 8/2004 | | |
| WO | 2005108210 | 11/2005 | | |
| WO | WO 2010007633 A1 * | 1/2010 | ..... | B65B 29/02 |
| WO | 2011041362 | 4/2011 | | |

OTHER PUBLICATIONS

Office Action issued by the State Intellectual Property Office of the People's Republic of China dated Jun. 11, 2015 for related Chinese patent application No. 2012800437898.

* cited by examiner

MACHINE FOR ASSEMBLING, FILLING AND SEALING PORTIONED BEVERAGE CAPSULES

This application is the National Phase of International Application PCT/IB2012/054607 filed Sep. 6, 2012 which designated the U.S. and that International Application was published under PCT Article 21(2) in English.

This application claims priority to Italian Patent Application No. MI2011A001619 filed Sep. 8, 2011, which application is incorporated by reference herein.

TECHNICAL FIELD

This invention relates to a machine for assembling, filling and sealing capsules for portioned beverages, of the type comprising a station for loading the capsules to be assembled, a station for unloading the assembled, filled and sealed capsules, a plurality of processing stations comprising at least one station for metering a product into the capsules and at least one station for sealing the capsules filled with the product, and an intermittent conveyor for conveying the capsules sequentially along a feed path from the loading station to the unloading station through the processing stations.

BACKGROUND ART

These machines face only one side along which the processing stations are distributed and define a layout in which the loading station and the unloading station are located at the two opposite ends of the side along which the processing stations are distributed.

Owing to this configuration, the machines therefore have a large footprint and are difficult to inspect and to have internal maintenance performed on them.

Also, these machines are not very versatile because the processing stations are mounted at non-adjustable positions to a shoulder of the machine base or to the base itself.

Moreover, sealing the capsules, especially when this involves creating a vacuum in the capsules and compensating for the vacuum by feeding an inert gas into them, is performed off line, thus reducing machine productivity.

DISCLOSURE OF THE INVENTION

The technical purpose this invention proposes to accomplish is therefore to provide a machine for assembling, filling and sealing capsules for portioned beverages which can overcome the above mentioned technical drawbacks of the prior art.

In the context of this technical purpose, one aim of the invention is to provide a machine for assembling, filling and sealing capsules for portioned beverages which has a convenient layout, with a small footprint and which is easy to inspect and to perform internal maintenance on.

Another aim of the invention is to provide a machine for assembling, filling and sealing portioned beverage capsules which is highly productive.

Yet another aim of the invention is to provide a machine for assembling, filling and sealing portioned beverage capsules which is highly flexible in use so it easily adapts to diverse applications.

The technical purpose, as well as these and other aims of the invention are achieved by providing a machine extending along a longitudinal axis, for assembling, filling and sealing capsules for portioned beverages, characterized in that it comprises a station for loading the capsules to be assembled, a station for unloading the assembled, filled and sealed capsules, a plurality of processing stations comprising at least one station for metering a product into the capsules and at least one station for sealing the capsules filled with the product, and an intermittent conveyor for conveying said capsules sequentially along a feed path from the loading station to the unloading station through the processing stations, the feed path having at least a first stretch which extends along a first lateral longitudinal side of the machine and at least a second stretch which extends along a second lateral longitudinal side of the machine, opposite the first lateral side.

Preferably, the filling station is located at the front side, that is to say, furthest away from the loading and unloading stations, which are the locations most difficult to control in terms of keeping adequate hygiene conditions.

According to an advantageous aspect of the invention, the machine comprises means for adjusting the position of at least some of the processing stations along the feed path and, more specifically, is equipped with a supporting plate for suspendedly supporting at least some of the processing stations.

According to a further advantageous aspect of the invention, the supporting plate itself is provided with the adjusting means.

The possibility of, if necessary, removing, and/or adjusting the positions of, the stations along the feed path makes the machine extremely flexible and adaptable to different processes requiring a different number of processing stations or different types of processing stations or processing stations in a different sequence or position.

Another advantageous aspect of the invention is that the sealing station comprises a sealing device with means for moving an assembly of its own in a manner synchronized with the movement of the intermittent conveyor.

The assembly concerned can be clamped onto bars which house the capsules applied to the intermittent conveyor, both to seal the capsules with a sealing lid and to create a vacuum in the capsules during the sealing thereof and compensate for the vacuum by feeding inert gas into them.

The fact that the capsules are sealed in process considerably increases the productivity of the machine because the machine does not need to be stopped for the capsules to be sealed.

BRIEF DESCRIPTION OF THE DRAWINGS

Further features and advantages of the invention are more apparent in the detailed description set out below of a preferred, non-limiting embodiment of a machine for assembling, filling and sealing capsules for portioned beverages as illustrated in the accompanying drawings, in which.

DETAILED DESCRIPTION OF THE PREFERRED EMBODIMENTS OF THE INVENTION

Figure 1:
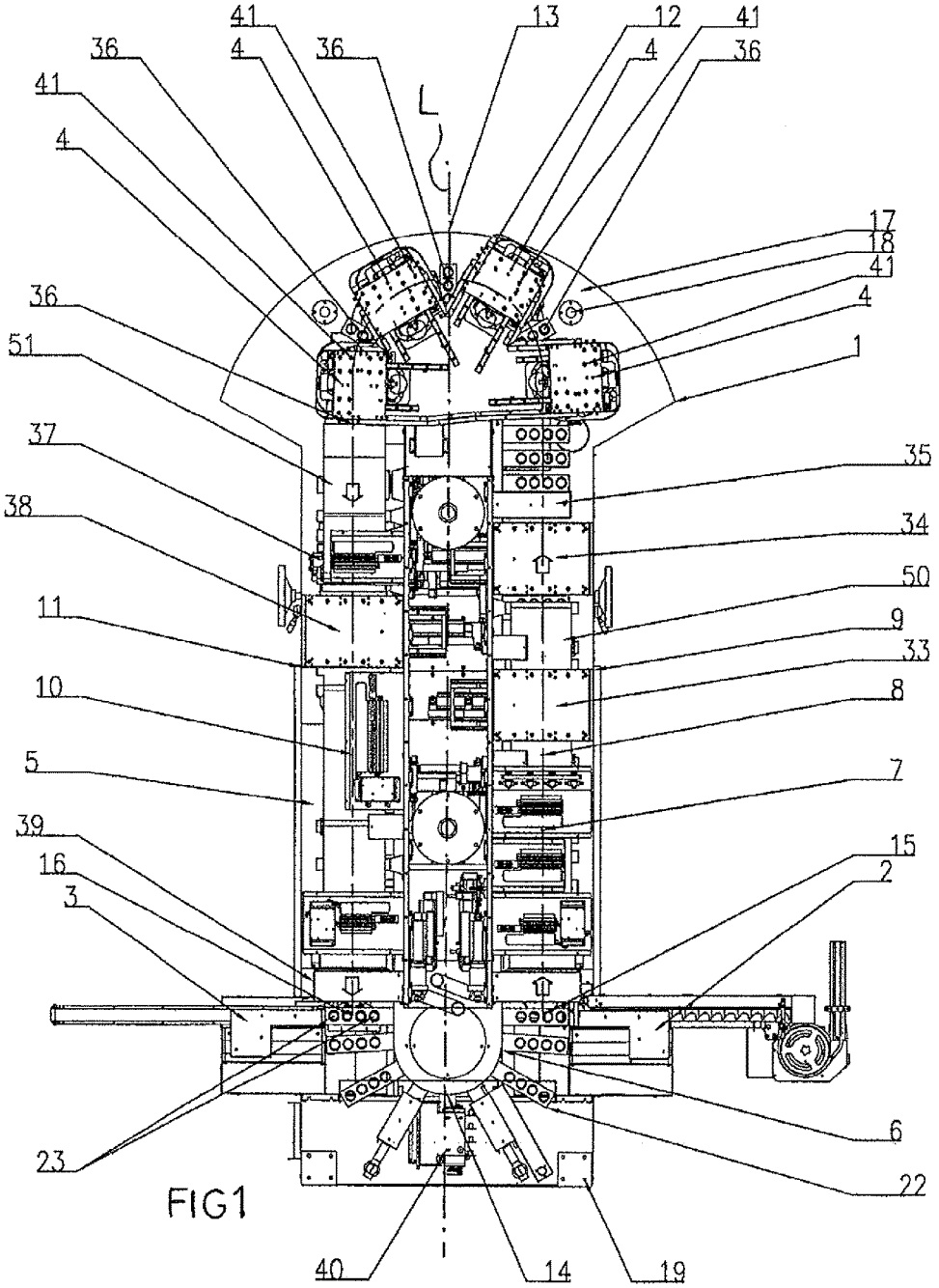
FIG. 1 shows a schematic plan view of the layout of the machine.
Figure 2:
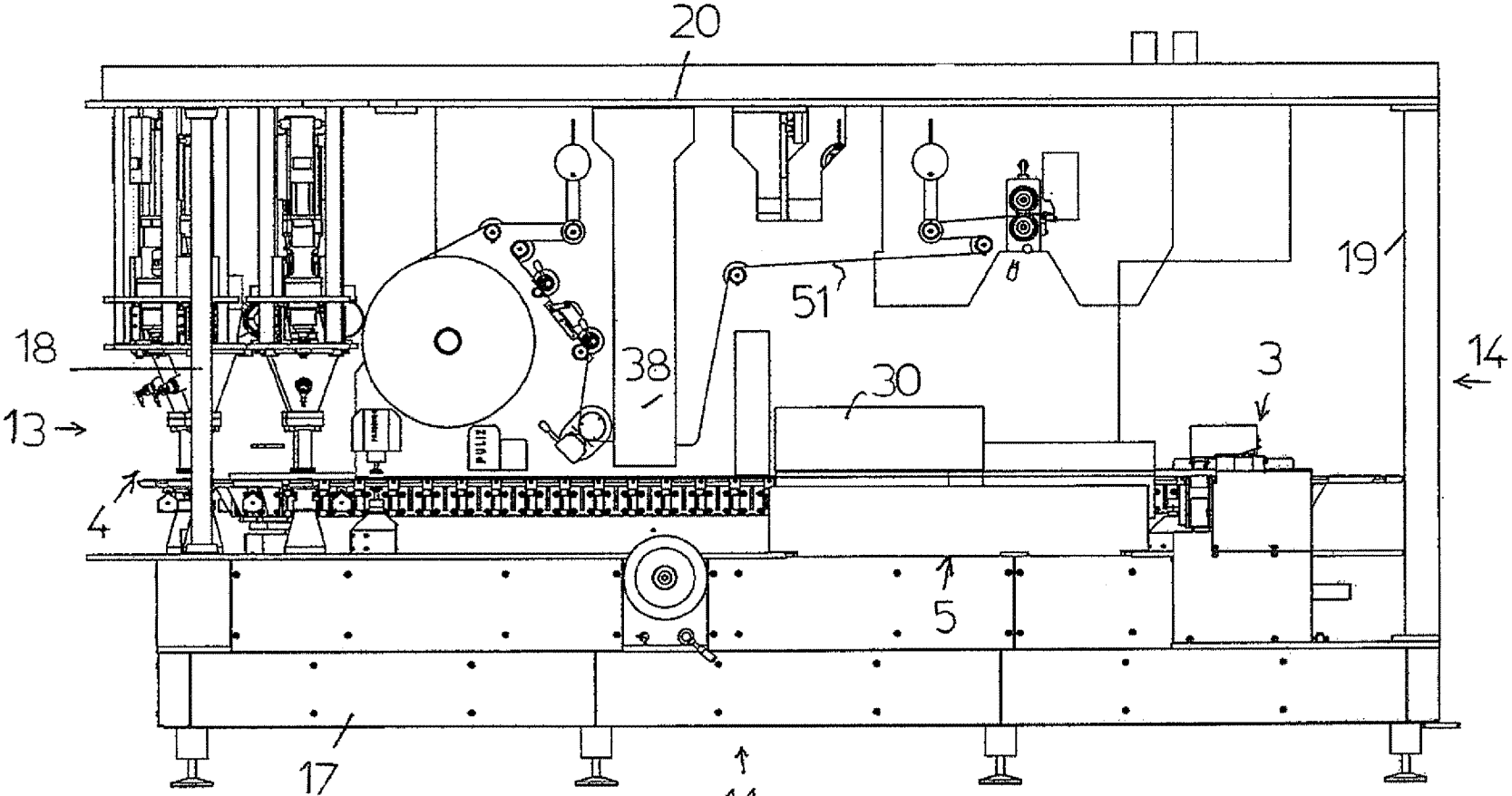
FIG. 2 shows the machine viewed from one lateral side of it.
Figure 3:
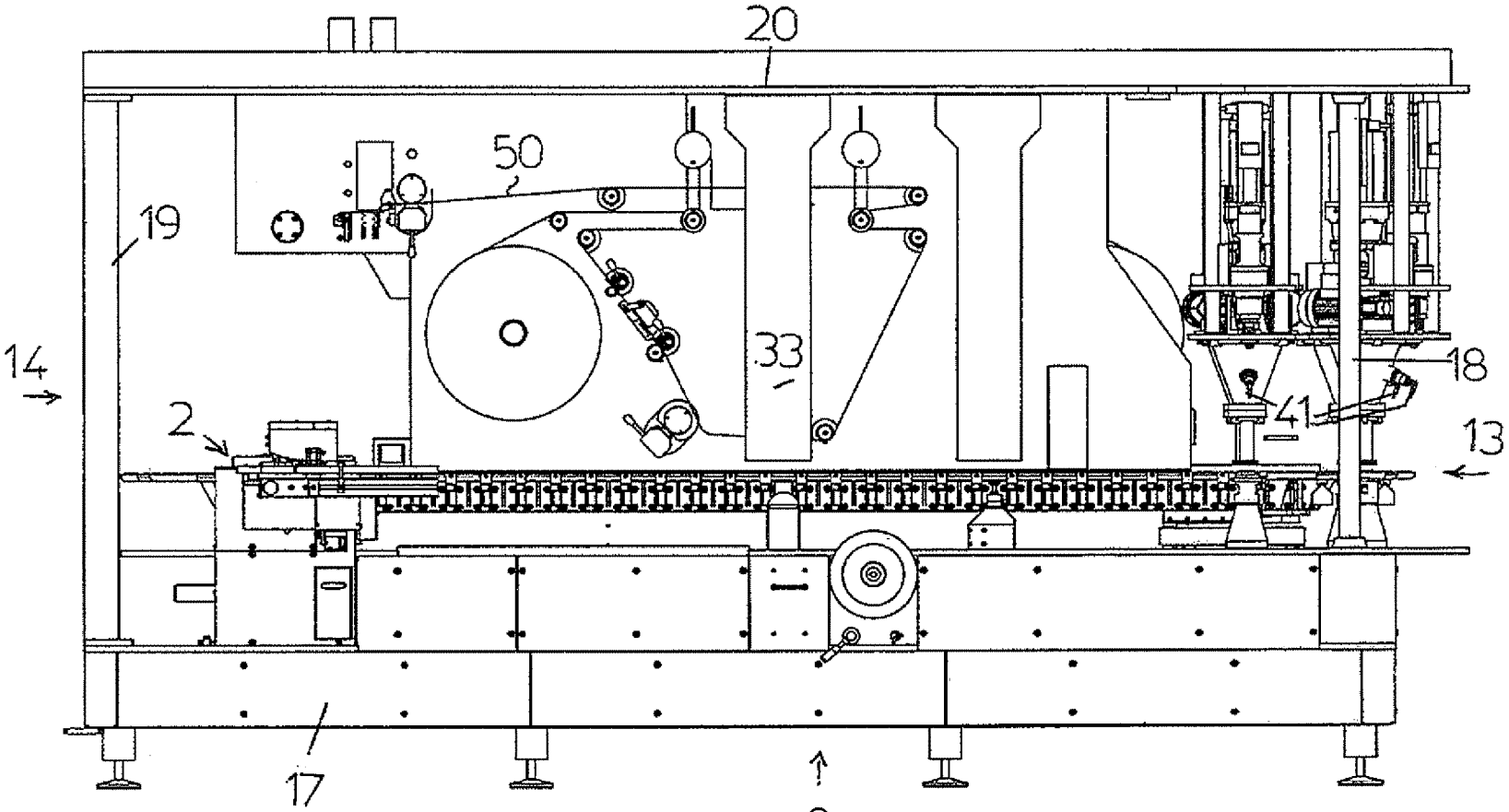
FIG. 3 shows the machine viewed from the lateral side opposite that of FIG. 2.
Figure 4:
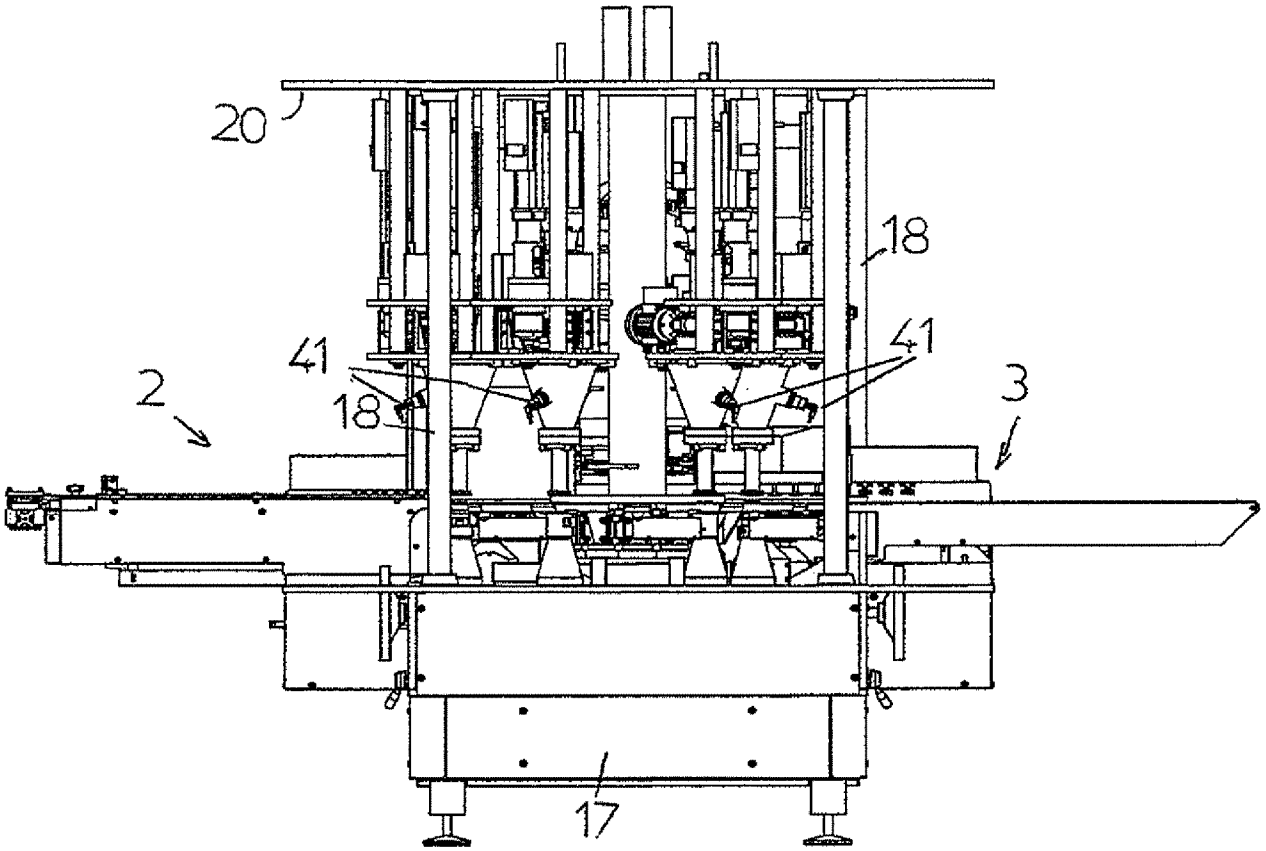
FIG. 4 shows the machine viewed from the front side of it.
Figure 5:
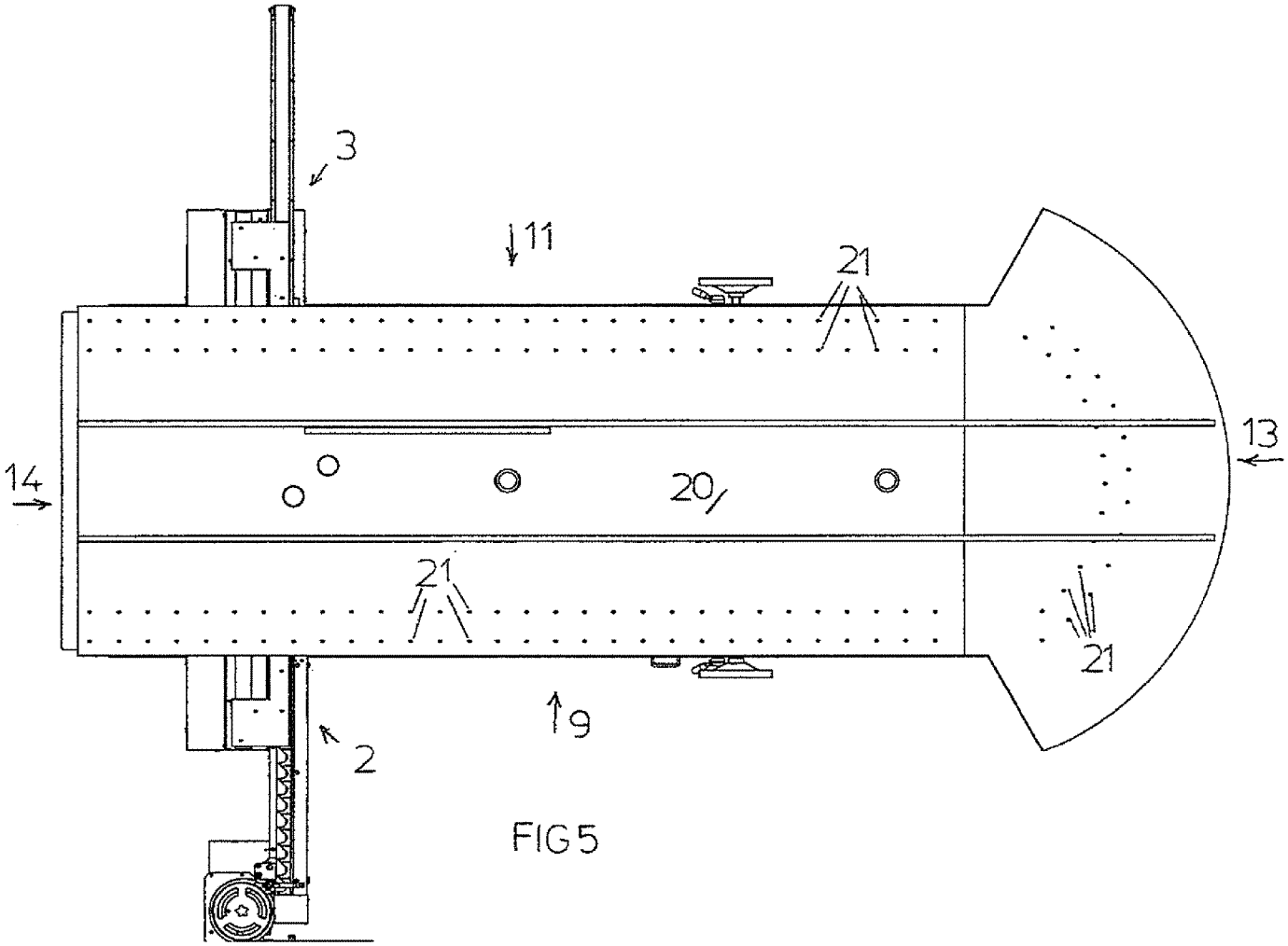
FIG. 5 shows a top plan view of the machine.
Figure 6:
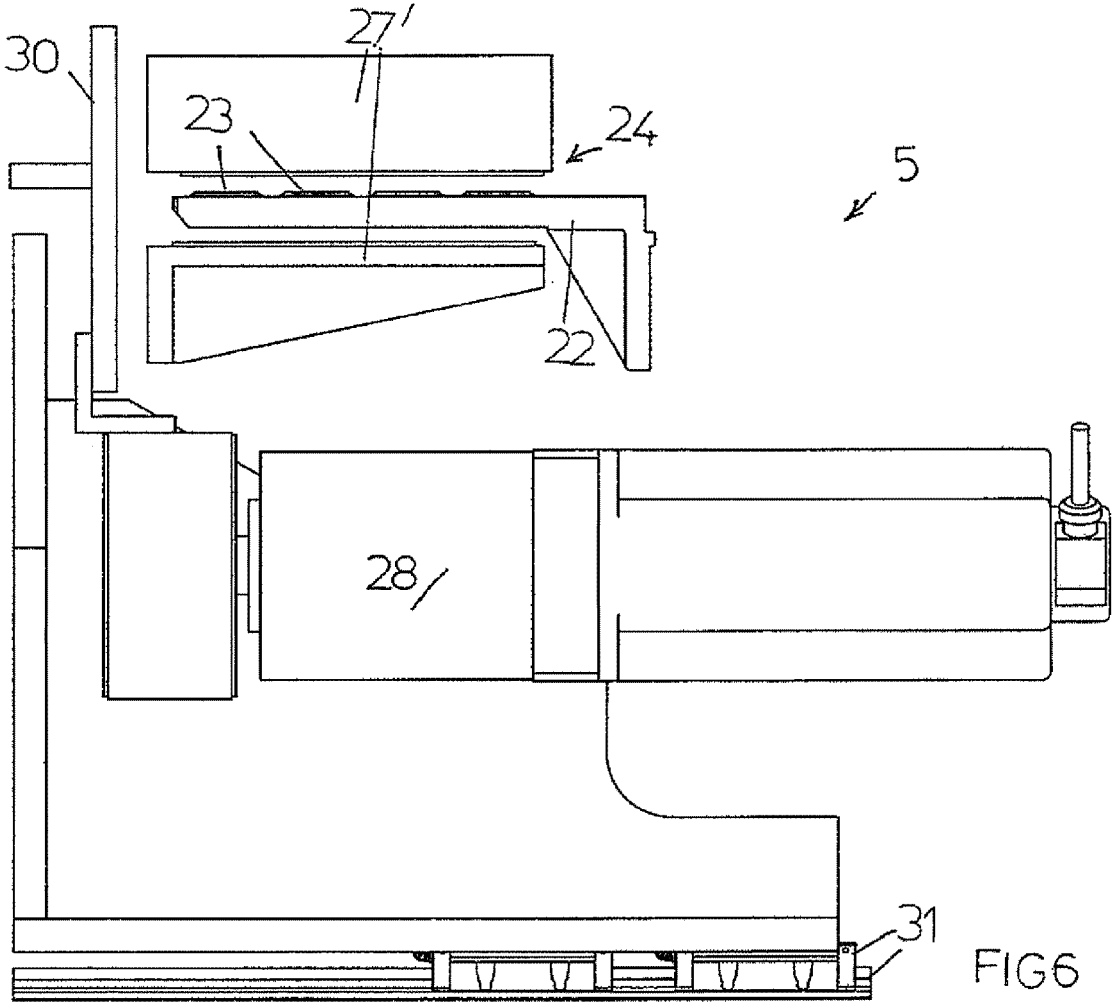
FIG. 6 shows the sealing station viewed from the rear side of the machine, with the assembly not clamped on the housing bars of the conveyor.
Figure 7:
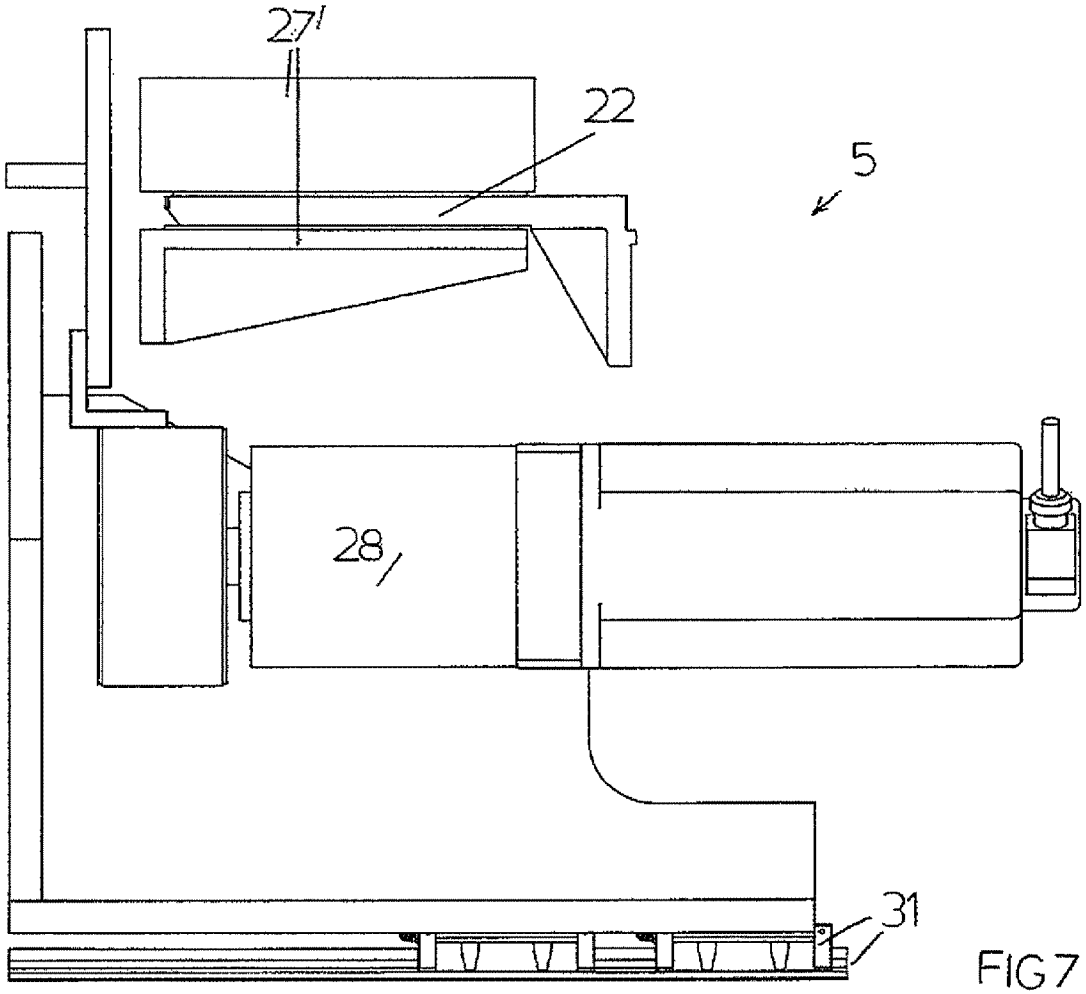
FIG. 7 shows the sealing station viewed from the rear side of the machine, with the assembly clamped on the housing bars of the conveyor.
Figure 8:
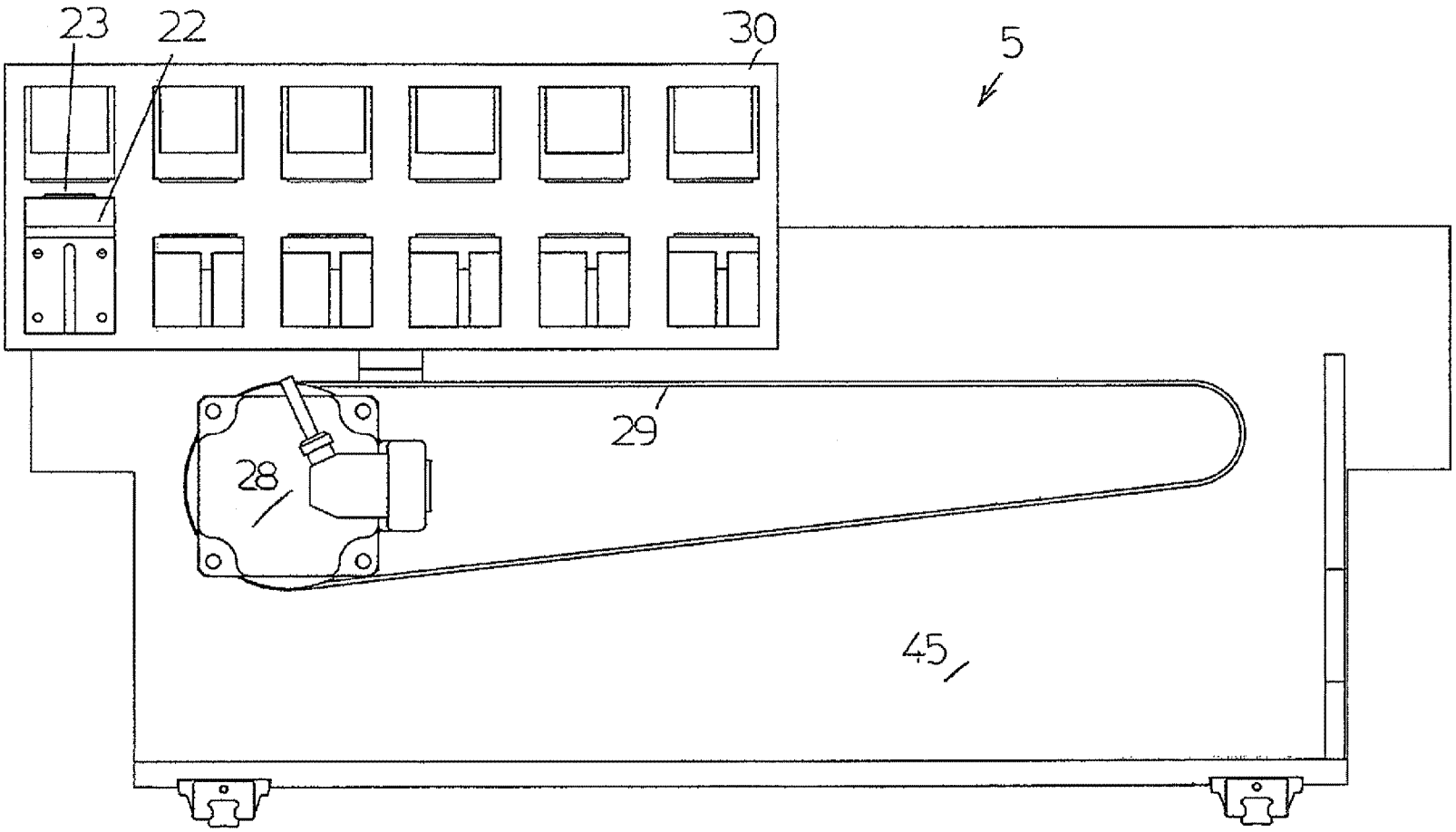
FIG. 8 shows the sealing station viewed from the lateral side of the machine, with the slider at the start of its stroke and with the assembly not clamped on the housing bars, of which the illustration shows, for convenience, only the last in the sequence aligned with the assembly.
Figure 9:
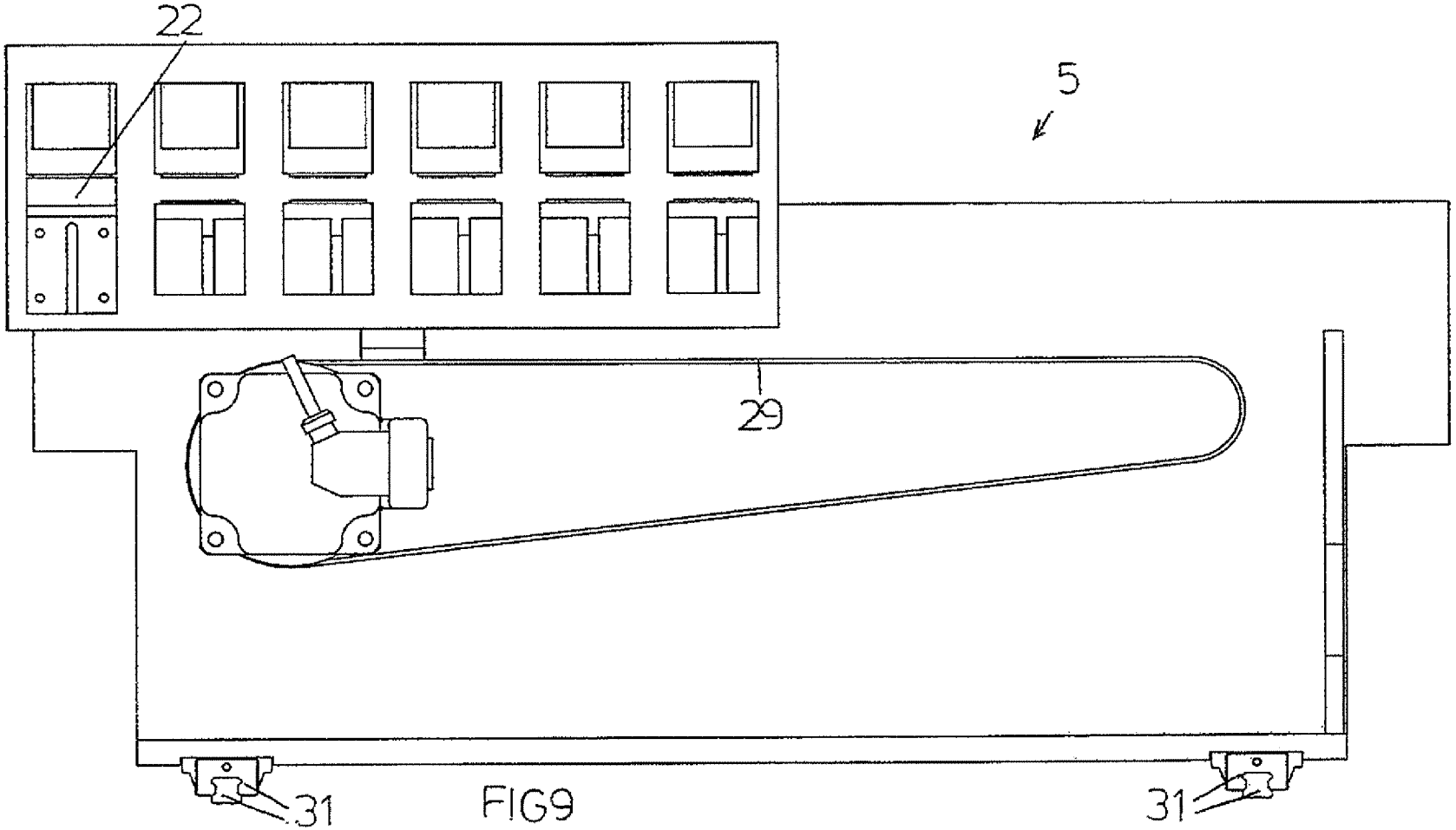
FIG. 9 shows the sealing station viewed from the lateral side of the machine, with the slider at the start of its stroke and with the assembly clamped on the housing bars, of which the illustration shows, for convenience, only the last in the sequence aligned with the assembly.
Figure 10:
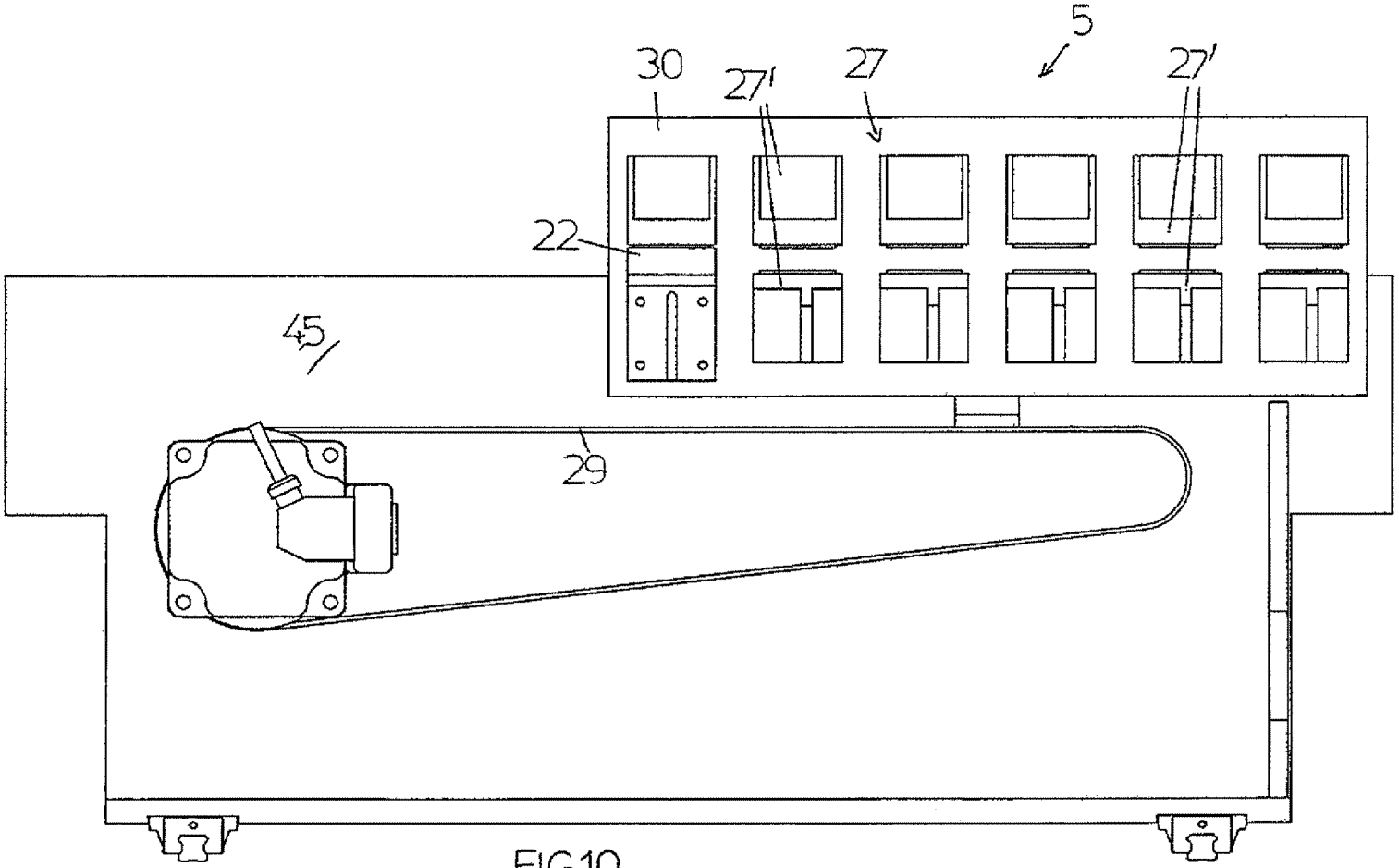
FIG. 10 shows the sealing station viewed from the lateral side of the machine, with the slider at the end of its stroke and with the assembly clamped on the housing bars, of which the illustration shows, for convenience, only the last in the sequence aligned with the assembly.
Figure 11:
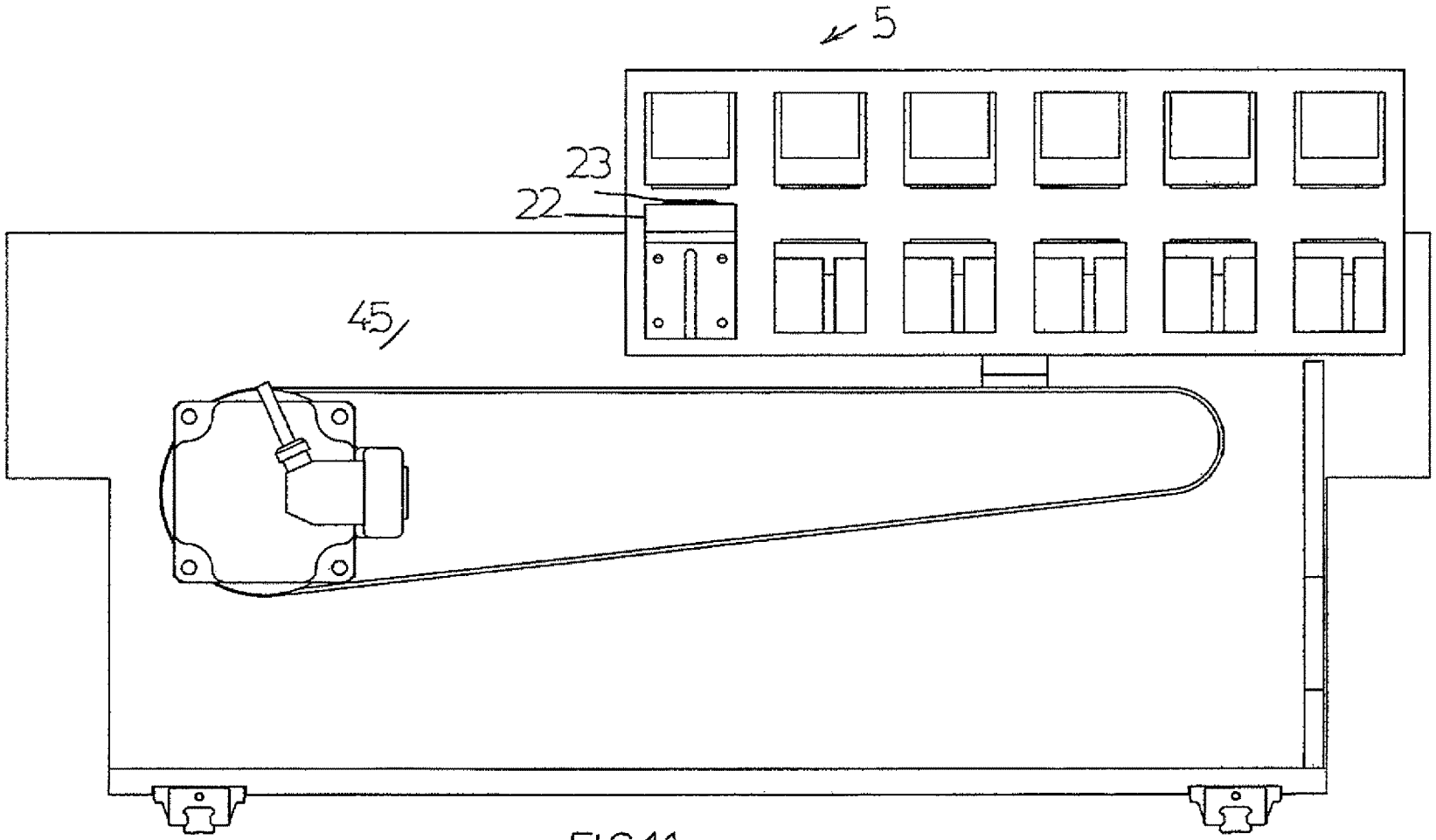
FIG. 11 shows the sealing station viewed from the lateral side of the machine, with the slider at the end of its stroke and with the assembly releasing the housing bars, of which the illustration shows, for convenience, only the last in the sequence aligned with the assembly.
Figure 12:
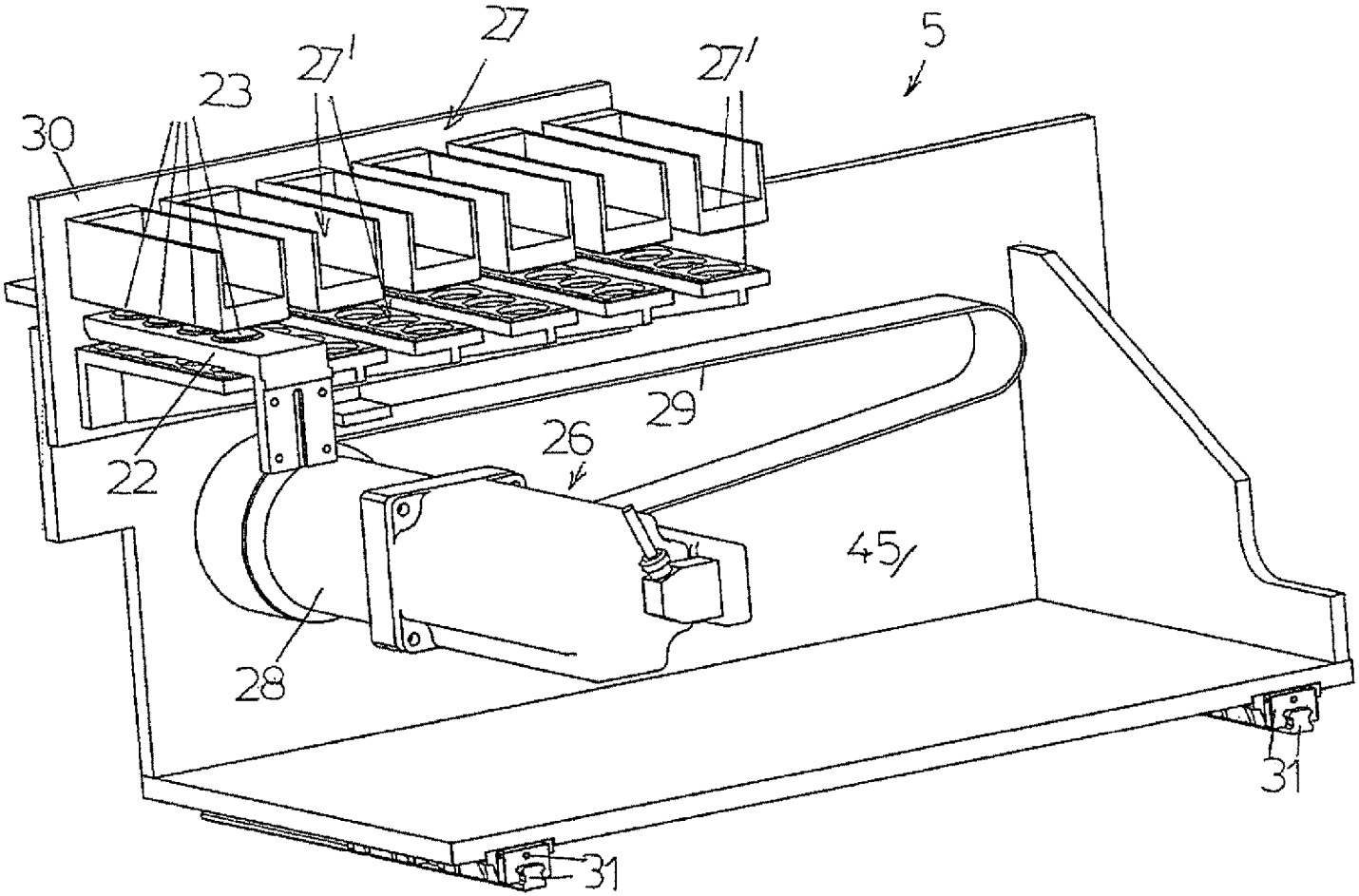
FIG. 12 is a perspective view of the sealing station showing, for convenience, only one of the housing bars of the conveyor.

The drawings listed above illustrate a machine 1 which extends along a longitudinal axis, labelled L, and which is used for assembling, filling and sealing capsules for portioned beverages, for example coffee.

The machine 1 comprises a station 2 for loading the capsules to be assembled, a station 3 for unloading the assembled, filled and sealed capsules 23, a plurality of processing stations comprising at least one station 4 for metering a product into the capsules and at least one station 5 for sealing the capsules 23 filled with the product.

The machine 1 comprises an intermittent conveyor 6 for transporting the capsules 23 in sequence along a feed path 7 (represented by a dot-dashed line in FIG. 1) from the loading station 2 to the unloading station 3 through the processing stations.

The conveyor 6 is preferably an endless track conveyor belt on which are mounted in cantilever fashion a sequential series of bars 22 for housing the capsules 23.

Each bar 22 in the series is spaced by one feed step of the conveyor 6 from the bar before it and the one after it and has a precise number of housings, for example four, for the capsules 23 aligned transversely to the feed path 7. This configuration of the conveyor 6 creates four parallel rows of capsules 23 travelling in synchronized manner.

The feed path 7 has at least a first stretch 8, having in particular a rectilinear configuration, which extends along a first lateral longitudinal side 9 of the machine 1, and at least a second stretch 10, also having in particular a rectilinear configuration, which extends along a second lateral longitudinal side 11 of the machine 1, opposite the first lateral side 9.

The feed path 7 also has at least a third stretch 12, having in particular a curved configuration, which joins the first stretch 8 to the second stretch 10 and which extends along a front side 13 of the machine 1.

The processing stations are distributed along the first stretch 8, along the second stretch 10 and along the third stretch 12 of the feed path 7.

Located at a rear side 14 of the machine 1 are both the start 15 of the first stretch 8 of the feed path 7, where the loading station 2 is, and the end 16 of the second stretch 10 of the feed path 7, where the unloading station 3 is.

The machine 1 comprises a base 17 equipped with uprights 18, 19 which mount at a position raised from the base 17 a supporting plate 20 for suspendedly supporting at least some of the processing stations.

The machine 1 advantageously comprises means for adjusting the position of at least some of the processing stations along the feed path 7.

Advantageously, the adjusting means are carried by the supporting plate 20.

In the preferred embodiment illustrated, the adjusting means comprise a plurality of fastening holes 21 distributed parallel to the feed path 7, to which the processing stations that must be suspended from the supporting plate 20 can be fastened.

In a different preferred embodiment not illustrated, the adjusting means comprise a guide which extends parallel to the feed path 7 and along which the processing stations suspended from the supporting plate 20 can be moved and locked at a desired position.

The sealing station 5 comprises a device 24 for sealing the capsules 23 located at the lateral side 11 of the machine 1.

The sealing device 24 comprises means 26 for moving an assembly 27 of its own in a manner synchronized with the movement of the intermittent conveyor 6.

The assembly 27 can be clamped onto the housing bars 22 both to seal the capsules 23 with a sealing lid and to create a vacuum in the capsules 23 during the sealing thereof and compensate for the vacuum by feeding an inert gas into them.

The means 26 for moving an assembly 27 comprise a motor 28 for driving a drive belt 29 to which there is fixed a slider 30 that supports the assembly 27.

The slider 30 is able to oscillate along a stroke parallel to the rectilinear stretch 10 of the feed path 7 between a sealing start position and sealing end position.

The slider 30 has a forward stroke towards the sealing end position, in which it is moved intermittently in a manner synchronized with the conveyor 6 while the assembly 27 is clamped on the housing bars 22, and a return stroke in which it moves towards the sealing start position while the assembly 27 is not clamped on the housing bars 22.

More specifically, the assembly 27 has a number n of units 27' (six in the embodiment illustrated) spaced from each other by one feed step of the conveyor 6 and each able to be activated in synchronized manner on a respective housing bar 22 of the consecutive sequences of n housing bars 22 able to be aligned with the assembly 27.

The unit 27' comprises two parts, both of which are movable, in particular by translational motion in opposite directions, between a clamped position, where they are clamped on opposite sides of the housing bar 22, and a released position, where they are spaced from the opposite sides of the housing bar 22.

Sealing lasts for a number n−1 of feed steps of the conveyor 6 so that in the time the conveyor 6 moves by another step the slider 30 can return to its starting position where the assembly 27 accordingly comes into alignment with the next sequence of n housing bars 22.

The motor 28 completes the forward stroke of the slider 30 in stepping fashion in the time taken by the conveyor 6 to move by n−1 feed steps and rapidly completes the return stroke of the slider 30 steplessly in the time taken by the conveyor 6 to move by one feed step.

The sealing device 24 is advantageously mounted on guides 31, 31 for sliding in a direction transversal to the rectilinear stretch 10 of the feed path 7 so that it can be easily accessed for inspection and maintenance.

More specifically, a fixed guide 31 is mounted to the base 17 and engages a guide 31 fixed to a frame 45 which mounts the motor 28 and, slidably, the slider 30.

The frame 45 is therefore slidable to allow the movable parts of the unit 27' to be moved out of alignment with the housing bar 22.

The nature of the processing stations depends on the structure of the capsules 23.

Purely by way of an example, therefore, the sequence of stations comprises the station 2 (of known type) for loading the containment bodies of the capsules 23, a station 33 (of known type) for punching and placing a filter paper on the bottom of the containment body of each capsule 23, a station 34 (of known type) for sealing the filter paper, a station 35 (of known type) for checking the presence and correct position of the filter paper, the metering station 4 (of known type) where the containment body of each capsule 23 is filled with a product, for example coffee, a station 36 (of known type) for checking the weight of the content of the containment body of each capsule 23, a station 37 (of known type) for pressing the product and cleaning the edge of the containment body of each capsule 23, a station 38 (of known type) for punching and placing a lid on the containment body of each capsule 23, the sealing station 5 where the lid is sealed to the containment body of the capsule 23, a station 39 (of known type) for checking the seal, a station 40 (of known type) for rejecting defective products, and the station 3 (of known type) for unloading the capsules 23.

The loading station 2 and the unloading station 3, for example comprise a respective oscillating pick and place system equipped with suction cups or grippers for picking up the containment bodies and the respective lids applied thereto.

The station 33 for punching a filter paper out of a web 50 and placing it on the bottom of the containment body of each capsule 23 is suspended at an adjustable position from the supporting plate 20.

The station 38 for punching a lid out of a web 51 and placing it on the containment body of each capsule 23 is suspended at an adjustable position from the supporting plate 20.

The metering station 4 is suspended from the supporting plate 20 advantageously at the front side 13 of the machine and comprises a precise number of independent screw fillers 41, for example four, connected to a feed chamber including a homogenizer and a grinder. More specifically, the four screw fillers 41 are angularly offset from each other along the curved stretch 12 of the feed path 7 and are configured to fill a precise, constant quantity of product into each of the capsules 23 of a line of capsules 23 every time the conveyor 6 stops.

The checking station 36 comprises, for example, a precise number of independent load cells, for example 4, each located downstream of a respective filler 41. During the time the conveyor 6 stops between steps, the capsules 23 are weighed and immediate feedback to the machine's control unit allows the screws of the fillers 41 to be corrected instantly, if necessary.

The pressing station 37 is equipped with a precise number of movable plates, for example four, each located downstream of a respective load cell. The plates are connected to suitable height and compaction detectors and allow the product compaction rate to be adjusted. In order to remove traces of product on the edges of the containment bodies of the capsules 23, this station is fitted with a dedicated suction device.

The operation of the machine is inferable from what is described and illustrated.

More specifically, all the processing stations except the sealing station 5 operate in the time the conveyor 6 stops between one feed step and the next, whilst the sealing station 5 also operates during the movement of the conveyor 6, since the assembly 27 follows the housing bars 22 for n−1 steps.

In some contexts, thanks to the possibility of easily modifying its configuration, the machine 1 allows considerable savings in labour costs for personnel in charge of its operation.

Indeed, where necessary, it is imaginable for two machines 1 to be configured symmetrically, with the loading stations 2 or the unloading stations 3 adjacent to each other.

That way, the loading stations 2 or the unloading stations 3 can be brought within the sphere of action of a single operator and other working units can be shared by both of the machines 1.

For example, if the unloading stations 3 are adjacent to one another, a single wrapping machine might be used for the assembled, filled and sealed capsules from both machines 1.

In practice, it has been found that the machine for assembling, filling and sealing capsules for portioned beverages according to the invention is particularly advantageous for its small footprint, ease of internal inspection, flexibility of use and productivity.

The machine for assembling, filling and sealing portioned beverage capsules as described above can be modified and adapted in several ways without thereby departing from the scope of the inventive concept. Moreover, all the details may be substituted for technically equivalent elements.

In practice the materials and dimensions used can be any, depending on requirements and on the state of the art.

The invention claimed is:

1. A machine extending along a longitudinal axis, for assembling, filling and sealing capsules of portioned beverages, comprising:

a loading station for loading the capsules to be assembled, an unloading station for unloading the assembled, filled and sealed capsules, a plurality of processing stations comprising a metering station for metering portioned beverage into the capsules and a sealing station for sealing the capsules filled with the portioned beverage, and an intermittent conveyor for intermittently conveying the capsules sequentially along a feed path in a plurality of feed steps from the loading station to the unloading station through the processing stations, the feed path including a first stretch which extends along a first lateral longitudinal side of the machine, a second stretch which extends along a second lateral longitudinal side of the machine opposite the first lateral side, and a third stretch joining the first stretch and the second stretch, the third stretch having a curved configuration;

wherein the intermittent conveyor includes a single endless track conveyor belt on which is mounted in cantilever manner a sequential series of bars for moving with the single endless track conveyor belt and housing the capsules, each bar of the sequential series of bars including a first end mounted to the single endless track conveyor belt and a second free end positioned away from the single endless track conveyor belt, each bar including a plurality of receptacles positioned between the first end and the second free end, each of the plurality of receptacles for receiving a capsule, the plurality of receptacles aligned transversely to the feed path, each bar remaining horizontal throughout the curved third stretch of the feed path such that the second free ends of the sequential series of bars positioned in the curved third stretch, and respective ones of the plurality of receptacles positioned adjacent the second free ends, change a distance between one another within a horizontal plane.

2. The machine according to claim 1, wherein the third stretch extends along a front side of the machine, the processing stations being distributed along the first, second and third stretches, the beginning of the first stretch, where the loading station is, and the end of the second stretch, where the unloading station is, being located at a rear side of the machine.

3. The machine according to claim 2, wherein the first and second stretches are rectilinear.

4. The machine according to claim 3, wherein the metering station is located at the front side, the third stretch extending along the front side.

5. The machine according to claim 3, and further comprising a supporting plate, the metering station comprising a plurality of independent screw fillers connected to a feed chamber including a homogenizer and a grinder being suspended from the supporting plate at the front side of the machine, the third stretch extending along the front side.

6. The machine according to claim 5, wherein the screw fillers are angularly offset from each other along the curved third stretch and are configured to fill a precise, constant quantity of portioned beverage into each of the capsules of a line of capsules on the bar every time the intermittent conveyor stops.

7. The machine according to claim 6, and further comprising a checking station for checking a weight of content of the containment body of each capsule, wherein the checking station comprises a plurality of independent load cells, each cell being located downstream of a respective screw filler, during a time the intermittent conveyor stops between steps, the capsules being weighed and immediate feedback being provided to a control unit of the machine to allow the screw fillers to be corrected instantly.

8. The machine according to claim 1, and further comprising an adjustment mechanism for adjusting a position of at least some of the processing stations along the feed path.

9. The machine according to claim 1, and further comprising a supporting plate for suspendedly supporting at least some of the processing stations.

10. The machine according to claim 9, wherein the supporting plate is provided with the adjusting mechanism.

11. The machine according to claim 10, wherein the adjusting mechanism comprises a plurality of fastening holes, distributed parallel to the feed path, to which the processing stations that must be suspended from the supporting plate can be fastened.

12. The machine according to claim 10, wherein the adjusting mechanism comprises a guide which extends parallel to the feed path and along which the processing stations suspended from the supporting plate can be moved and locked at a desired position.

13. The machine according to claim 1, wherein the sealing station comprises a sealing device having a system for moving an assembly thereof in a manner synchronized with the movement of the intermittent conveyor.

14. The machine according to claim 13, wherein the assembly can be clamped onto the bars, both to seal the capsules with a sealing lid and to create a vacuum in the capsules during the sealing thereof and compensate for the vacuum by feeding an inert gas into them.

15. The machine according to claim 14, wherein the assembly comprises units, each comprising two parts, both movable between a clamping position, in which they are clamped on opposite sides of a respective one of the bars, and a release position, in which they are spaced from the opposite sides of a respective one of the bars.

16. The machine according to claim 13, wherein the system for moving the assembly comprises a motor for driving a drive belt to which there is fixed a slider that supports the assembly, the slider being able to oscillate along a stroke parallel to a rectilinear stretch of the feed path between a sealing start position and a sealing end position.

17. The machine according to claim 16, wherein the slider has a forward stroke towards the sealing end position, in which it is moved intermittently in a manner synchronized with the intermittent conveyor while the assembly is clamped on the housing bars, and a return stroke in which it moves towards the sealing start position while the assembly is not clamped on the housing bars.

18. The machine according to claim 17, wherein the sealing device slides in a direction parallel to the rectilinear stretch of the feed path.

19. The machine according to claim 1, wherein each bar in the sequential series of bars is spaced by one feed step of the intermittent conveyor from a leading bar positioned ahead of the bar and also spaced by one feed step of the intermittent conveyor from a trailing bar positioned behind the bar.

20. The machine according to claim 1, and further comprising:

- a station for punching and placing a filter paper on a bottom of a containment body of each capsule;
- a station for sealing the filter paper;
- a station for checking a presence and a correct position of the filter paper;
- a station for checking a weight of content of the containment body of each capsule;
- a pressing station for pressing the portioned beverage and cleaning an edge of the containment body of each capsule;
- a station for punching and placing a lid on the containment body of each capsule;
- the sealing station, where the lid is sealed to the containment body of the capsule;
- a station for checking a seal of the lid and the containment body of the capsule;
- a station for rejecting defective capsules.

21. The machine according to claim 20, wherein the pressing station is fitted with a dedicated suction device, in order to remove traces of portioned beverage on edges of the containment bodies of the capsules.

22. The machine according to claim 1, wherein the portioned beverage is coffee.

23. The machine according to claim 1, wherein the plurality of processing stations includes a first processing station including an upper portion for operatively engaging tops of the capsules, a lower portion for operatively engaging bottoms of the capsules, and an intermediate frame connecting the upper portion and the lower portion to form a C-shaped structure having an open side facing toward the intermittent conveyor and a closed side positioned away from the intermittent conveyor, the first processing station positioned such that the upper portion and the lower portion vertically overlap the second free ends of the sequential series of bars as the second free ends of the sequential series of bars enter the processing station via the open side.

24. A system for assembling, filling and sealing capsules of portioned beverages comprising:

a first machine and a second machine, each of the first machine and the second machine comprising:

a loading station for loading the capsules to be assembled, an unloading station for unloading the assembled, filled and sealed capsules, a plurality of processing stations comprising a metering station for metering portioned beverage into the capsules and a sealing station for sealing the capsules filled with the portioned beverage, and an intermittent conveyor for intermittently conveying the capsules sequentially along a feed path in a plurality of feed steps from the loading station to the unloading station through the processing stations, the feed path including a first stretch which extends along a first lateral longitudinal side of the machine, a second stretch which extends along a second lateral longitudinal side of the machine opposite the first lateral side, and a third stretch joining the first stretch and the second stretch, the third stretch having a curved configuration;

wherein the intermittent conveyor includes a single endless track conveyor belt on which is mounted in cantilever manner a sequential series of bars for moving with the single endless track conveyor belt and housing the capsules, each bar of the sequential series of bars including a first end mounted to the single endless track conveyor belt and a second free end positioned away from the single endless track conveyor belt;

wherein each bar in the sequential series of bars is spaced by one feed step of the intermittent conveyor from a leading bar positioned ahead of the bar and also spaced by one feed step of the intermittent conveyor from a trailing bar positioned behind the bar, each bar of the sequential series of bars including a plurality of receptacles positioned between the first end and the second free end, each of the plurality of receptacles for receiving a capsule, the plurality of receptacles aligned transversely to the feed path, each bar remaining horizontal throughout the curved third stretch of the feed path such that the second free ends of the sequential series of bars positioned in the curved third stretch, and respective ones of the plurality of receptacles positioned adjacent the second free ends, change a distance between one another within a horizontal plane;

wherein the first machine and the second machine have a symmetrical configuration to one another and are reciprocally positioned such that the loading stations of the first and second machines or the unloading stations of the first and second machines are adjacent to each other.

25. The machine according to claim 24, wherein the plurality of processing stations includes a first processing station including an upper portion for operatively engaging tops of the capsules, a lower portion for operatively engaging bottoms of the capsules, and an intermediate frame connecting the upper portion and the lower portion to form a C-shaped structure having an open side facing toward the intermittent conveyor and a closed side positioned away from the intermittent conveyor, the first processing station positioned such that the upper portion and the lower portion vertically overlap the second free ends of the sequential series of bars as the second free ends of the sequential series of bars enter the processing station via the open side.

* * * * *